United States Patent [19]

Mattson

[11] 4,092,832

[45] June 6, 1978

[54] METHOD OF CORRECTING THE HEIGHT LEVEL OF A FOUNDATION

[75] Inventor: Arne J. Mattson, Vesteras, Sweden

[73] Assignee: Paul Anderson Industrier AB, Vesteras, Sweden

[21] Appl. No.: 721,030

[22] Filed: Sept. 7, 1976

[51] Int. Cl.[2] ..... E02D 27/48; E02D 5/48

[52] U.S. Cl. ..... 61/51; 404/78

[58] Field of Search ..... 61/51, 35, 50, 86, 63, 61/36; 52/169, 50; 404/78

[56] References Cited

U.S. PATENT DOCUMENTS

| | | | |
|---|---|---|---|
| 1,644,572 | 10/1927 | Ferry et al. | 61/51 |
| 2,322,855 | 6/1943 | Lenahan | 61/51 |

FOREIGN PATENT DOCUMENTS

| | | | |
|---|---|---|---|
| 212,189 | 4/1967 | Sweden | 61/51 |

*Primary Examiner*—Jacob Shapiro

*Attorney, Agent, or Firm*—Sughrue, Rothwell, Mion, Zinn and Macpeak

[57] ABSTRACT

Disclosed is a method of correcting the height level of a concrete foundation or the like which is supported on a loose soil material. The bearing capacity of the soil material has been locally increased under the foundation by means of an oblong casing which is open at its opposite ends and has been driven down into the ground in order to isolate with respect to lateral movements in the soil masses a predetermined soil volume from the surrounding soil. The correction of the height level is carried out by injecting a moveable material mass beneath the foundation in the isolated soil at such a pressure that the foundation is raised.

4 Claims, 4 Drawing Figures

METHOD OF CORRECTING THE HEIGHT LEVEL OF A FOUNDATION

This invention relates to a method of correcting the height level of a concrete foundation or the like which is supported on a loose soil material, the bearing capacity of which has been locally increased, particularly in connection with the laying of foundations intended to receive heavy loads, rendering possible compensation in a simple manner for settlements possibly taking place in the soil beneath such foundations.

When laying foundations on loose soil, the method most commonly used today for bringing about the necessary bearing capacity is to drive piles into the soil area where the foundation is to be laid. Piling, however, is relatively expensive and particularly so when the foundation is intended only for temporary use. This is the case, for example, when large harbour or shipyard cranes must be lifted into position, because for this purpose provisional support points are used to carry the entire weight of the structure which may amount to one or several thousands of tons. The loads, consequently, are highly concentrated and, moreover, hoisting work of this kind usually is carried out very close to and at times in water where the soil often is loose and, for example, consists to a very substantial depth of pretty fine sand. This involves considerable problems in the laying of reliable foundations for receiving such loads, because the foundations, besides, are to be carried out at relatively low costs as they usually are utilized only at a single occasion. When a concrete plate would be cast directly on the ground, the plate would have to be given very large dimensions in order to provide space for a necessary spread of the loads. An other known alternative is piling which, however as already mentioned, is very expensive.

In the Swedish patent No. 7411306–9 applicant has disclosed a solution to this problem according to which the natural bearing capacity of the soil is increased locally, in such a manner, that the areas with increased bearing capacity can be used as supporting points, for example in connection with the casting of a concrete plate for receiving desired loads. The plate can be given dimensions substantially smaller than when the plate would be positioned directly on unprepared ground. Conventional piling is not required.

The local increase in bearing capacity is achieved according to said patent by isolating defined soil volumes with respect to lateral movements in the soil layers from the surrounding soil, so that the lateral movements in the isolated soil volumes are reduced to a minimum. The isolation of the soil volumes is effected by driving into the ground oblong casings, which are open at their opposite ends and preferably have a circular cross-section in the form of cylinders or truncated cones. The driving-down operation can be carried out by vibration, possibly with the supply of pressure water. In order to facilitate the driving work, a substance serving as lubricant can be supplied along the lower end edge of the casings in connection with the driving work.

For foundations to be used only temporarily, the casings can be made of sheet metal. The method according to the patent, however, can also be utilized for the laying of permanent foundations, provided that the material in the casing walls can be prepared or chosen so that it will not be broken down. One way of producing permanent walls is that while, for example, a sheet metal cylinder is vibrated into the ground, a substance, suitably concrete, is supplied continuously along the lower end edge of the cylinder. In such a case the concrete will subsequent to its setting, form a permanent wall of cylindric shape. In order to facilitate the supply of said substance, the sheet metal cylinder preferably is provided with a thickened lower end edge, and the substance is injected into the hollow space formed above said thickened portion when the cylinder is being driven into the ground.

It is desirable that the soil volumes enclosed by the casings are compressed to the greatest possible extent. This can, within the limits of available driving-down resources, take place thereby, for example, that the casings have a conic shape and are driven down with the wider end facing downwards. The driving operation carried out in this way will be possible only when the volume of the enclosed mass can be reduced while the casing is being driven down. A further advantage of the conic design of the casings is that they can be inserted into each other at their storage and during their transport, thereby reducing substantially the required space.

When said casings are driven into the ground by vibration, this will also bring about a compaction of the material enclosed by the casings. This compaction can be improved by sucking out water of said material when the vibration work is completed. In order to additionally increase the bearing capacity of the isolated soil volumes, after the casings have been driven down to the desired depth, a known technique can be applied to compress the isolated volume still more, for example by continued vibration, vibroflotation, electro-osmosis, driving-in of piles, injection or a combination of these measures.

In spite of the above measures settlements may yet take place in the soil material beneath a foundation especially when heavy loads are applied.

A main object of the present invention is to obtain a method rendering it possible to restore in a simple manner the correct height level and/or inclination for the foundation, upon a settlement.

This is achieved by injecting into the soil material isolated by a casing and supporting the foundation a movable material mass at such a pressure that the foundation is caused to rise, the size of the rise being dependent on the amount of mass being injected. Thus, the material mass will act like a hydraulic fluid and force the foundation, corresponding to the piston, upwards.

For this purpose, in the soil material beneath the foundation one or more layers are arranged above and defined relative to each other of a material forming distribution passages, and injection pipes are provided to extend through said foundation and down into the layer in question. It is hereby possible, in the event of a settlement of the material in the casing, to inject mass into said layer or one of said layers in such a manner, that the injected mass spreads over the entire cross-sectional area of the casing and acts as a hydraulic piston for pressing the foundation up the desired distance. As injection mass suitably concrete mortar of the type floating concrete can be used, because in the case of several desired corrections one separate layer can be used for each of these corrections. Alternatively, a mortar can be used at which the cement has been replaced by clay, possibly with bentonite addition. Said layers may, for example, contain shingle, which forms cavities and passages for distributing the injected mass. Between the injected mass and the inner surface of the casing a suitable material is provided preventing said mass from adhering to the casing wall.

The characterizing features of the invention become apparent from the attached claims.

The invention is described in greater detail in the following with reference to the Figures in the accompanying drawings, of which:

Figure 1:
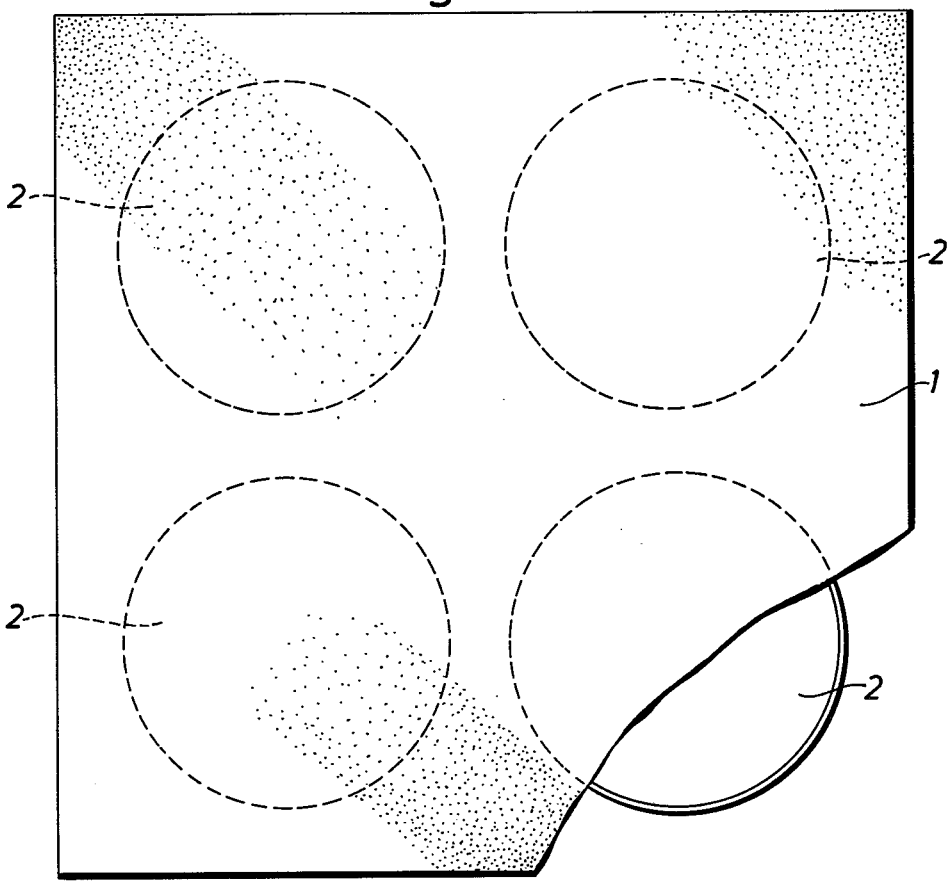
FIG. 1 shows a concrete foundation laid according to the prior art.

The concrete foundation shown in FIG. 1 is intended to receive heavy concentrated loads and comprises an upper concrete plate 1 supported on four homogenous concrete cylinders 2. The concrete cylinders are arranged directly on the soil which, for example, consists of loose sand and in the places for said cylinders has been prepared for obtaining a bearing capacity increased substantially over that of the surrounding soil.

Figure 2:
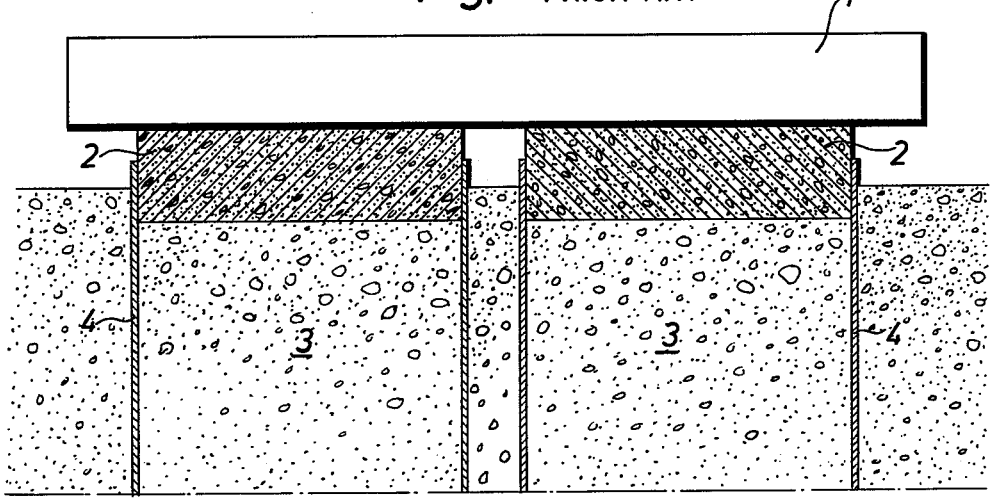
Fig. 2 PRIOR ART
FIG. 2 is a section through the base plate according to FIG. 1 and the foundation therefor.

As is apparent from FIG. 2, the concrete cylinders 2 rest on soil volumes 3, which with respect to lateral movements in the soil are isolated from surrounding soil masses by sheet metal cylinders 4 driven into the ground. In the case of loose soil, there would otherwise occur lateral movements in the soil masses when the concrete cylinders 2 are subjected to load and thereby render it impossible to lay a stable foundation without the load being spread over a substantial surface. Due to the isolation of smaller soil volumes, however, by driving the sheet metal casings 4 being open at their opposite ends into the ground, the possibility is eliminated that the soil volumes enclosed in the cylinders when being subjected to load are pressed laterally outward. Even a relatively loose soil can hereby provide a bearing capacity sufficient for great concentrated loads when these are distributed over substantially the entire upper surface of each isolated soil volume 3. This has been achieved according to FIG. 2 by means of the concrete cylinders 2, the cross-sectional area of which agrees with that of the sheet metal cylinders, but which can move in vertical direction relative to the same.

As an example of the bearing capacity can be mentioned that in a case, in which the sand substantially is located beneath water, the driving of a cylinder with a diameter of 2,7 m to a depth of 16 m should bring about a load bearing capacity of 1.250 tons.

When preparing for a foundation, thus, sheet metal cylinders 4 corresponding in number to the size of the load to be carried are driven down, whereafter a concrete cylinder 2 is positioned into each cylinder to carry the concrete plate 1 distributing the load. The sheet metal cylinders 4 can be manufactured with relatively thin walls, as they will not be subjected to great forces, because the horizontal forces originating from the vertical forces will be of substantially smaller size. By manufacturing the casings of a material with distinct yield strength, the outer passive earth pressure can be utilized to permit an additional compaction in the enclosed material. The cylinders preferably are driven down by vibration. The concrete cylinders, furthermore, are given such a height that the concrete plate 1 does not come into contact with the sheet metal cylinders 4 even when certain settlements should occur. At the embodiment shown, the concrete cylinders 2 extend into the cylinders 4 below the surrounding soil level and thereby reduce the stresses on the upper portions of the same.

The aforedescribed method is particularly suitable for being utilized at temporary foundation, because it is simple and can be carried out at low cost. It, further, ensures that the foundation and base plate simply can be removed after use. The method, of course, can also be supplied in connection with permanent foundations, provided that the casing walls can be made of a durable material. One method of producing a permanent casing in the soil according to above is, that in connection with the driving by vibration of e.g. a sheet metal cylinder into the ground along its lower end edge a mass, preferably concrete, is supplied which after its setting forms a second permanent wall on one or both sides of the sheet metal wall driven down. In order to facilitate such injection of concrete, at the lower end edge of the sheet metal cylinder a thickened portion can be provided, for example by build-up welding of an angular iron, whereby the concrete is supplied to the hollow space which temporarily is formed directly above said thickened portion when the sheet metal cylinder is being driven down.

Figure 3:
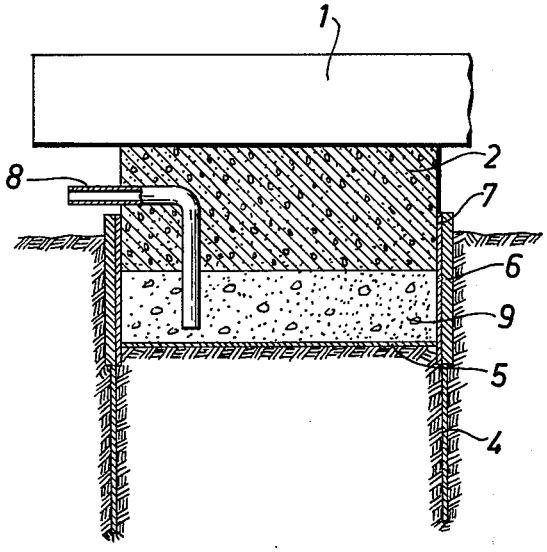
FIG. 3 is a section through a foundation according to the invention beneath which an injection layer is provided to permit correction in height.
Figure 4:
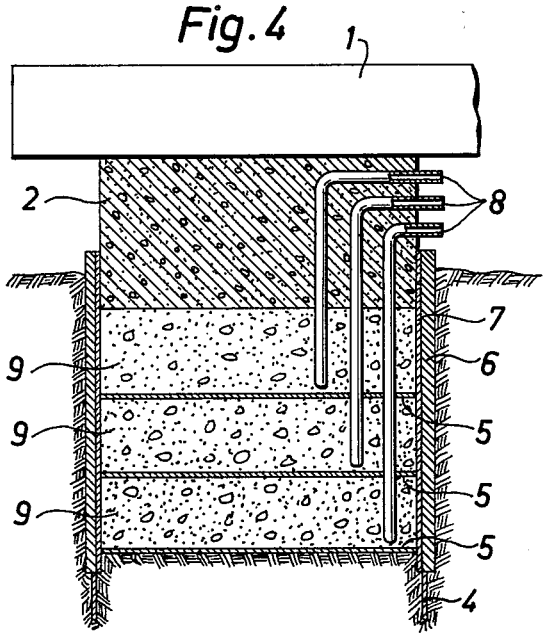
FIG. 4 is a corresponding section through a foundation resting on three injection layers.

Especially when heavy loads are applied settlements may occur in the soil isolated in the cylinders. FIGS. 3 and 4 illustrate how the height level for a foundation laid according to above can be adjusted in accordance with the present invention in the event of settlements in the soil material.

When in the different sheet metal cylinders carrying one and the same concrete plate 1 settlements of varying size take place, the plate and the structure supported thereon will incline and possibly be subjected to undesirable stresses. For possible compensation for such settlements of different kind, according to the invention one or more material layers 9 are arranged beneath the concrete cylinder 2 in each sheet metal cylinder 4. The layers consist of a material, which forms distribution passages for an injection mass and preferably is a relatively coarse gangue material, such as shingle.

According to FIG. 3 the concrete cylinder 2 rests on a shingle layer 9, which is isolated from the underlying material in the cylinder 4 by means of a metal sheet 5. An upper portion 6 of the sheet metal cylinder 4 corresponding at least to the thickness of the shingle layer 9 is manufactured with a higher wall strength, usually a wall thickness exceeding that of the cylinder in general. The shingle layer 9 is also held isolated from the cylinder wall by means of a plate-shaped material 7 covering the inner surface of the cylinder along said upper portion 6. An injection pipe 8 opening into the lower portion of the shingle layer 9 is cast into the concrete cylinder 2.

When in the material enclosed in the cylinder 4 according to FIG. 1 settlement takes place, and as a result thereof the level for the concrete plate 1 will sink and said plate possibly incline in an undesirable manner, the height level of the plate 1 can be restored by using the shingle layer 9. For this purpose a suitable injection mass is forced with pressure into the shingle layer via the injection pipe 8. Due to the porosity of the layer 9 the injected mass is distributed substantially uniformly over the entire area of the cylinder 4 and forms a hydraulic piston, which at sufficient feed pressure will press the concrete cylinder 2 with the plate 1 up to the desired level. The injected mass, which for example may be cement mortar, subsequent to its setting will practically form an extension of the previous concrete cylinder 2. It is of importance in this connection that the injected mass is prevented from adhering on the cylinder wall. For this reason the plate 7 is provided, because otherwise there is a risk of great forces being transferred to the sheet metal cylinder 4, which is not dimensioned to resist such forces. In order to resist, however, to the hydraulic pressure in connection with the injection operation, the upper portion 6 of the cylinder 4 as mentioned is manufactured with a greater wall thickness.

When, for example, the load on the concrete plate 1 increases successively, for example in connection with the erection of a building structure, it may be suitable and, respectively, necessary to be able to carry out several height adjustments of the foundation at different times, for example in order to compensate for level changes due to successive settlements in the soil masses in the sheet metal cylinders 4. In order to render possible such compensation, a plurality of shingle layers 9 according to FIG. 3 can be arranged above and isolated relative to each other by means of intermediate metal sheets 5 as shown in FIG. 4. To each of said layers a separate injection pipe 8 is laid, which pipes open into the lower portion of the associated shingle layer.

When a settlement of such a size has taken place that a level compensation is desired, an injection is carried out according to the disclosure in connection with FIG. 3 into the lowermost of the layers 9. After a settlement possibly having occurred at a later occasion, the central shingle layer 9 can be used for a level correction in a corresponding manner. The uppermost shingle layer 9 should be kept in reserve until the entire building structure and therewith the total load could act upon the foundation for a certain time, whereafter a final adjustment can take place. When at the injection into said lastmentioned layer a material is used which does not set to form a definitely solid body, possibly further injections can be made into this layer at a later date. Examples of such materials have been mentioned above and include clay mortar possibly with bentonite addition. With slowly setting materials it may be suitable to provide the injection pipe 8 with an end closure at its outer end.

The method can be varied in several respects. The shingle layers according to FIGS. 3 and 4, for example, can be replaced by another suitable material and possibly to a certain part be replaced by or completed with pipe systems laid in the layers with their openings uniformly distributed over the cross-sectional area of the cylinder. Furthermore, both the number of shingle layers and the type of injection mass can be chosen according to desire. The method can also be applied without distribution layer, in which case the injected mass spreads in the existing soil layer.

I claim:

1. In a method of correcting the height level of a concrete foundation or the like which is supported on a loose soil material, the bearing capacity of which has been locally increased under the foundation by means of an oblong casing open at its opposite ends and driven down into the ground in order to isolate with respect to lateral movements in the soil masses a predetermined soil volume from the surrounding soil, the improvement comprising the steps of: providing at least one layer of a material having distribution passages beneath the foundation, and injecting a moveable material mass into said layer at a pressure capable of rising the foundation.

2. A method according to claim 1, comprising using as material for said layers a substantially coarse gangue material.

3. A method according to claim 1, comprising arranging several separated layers above each other, each layer having distribution passages associated therewith and injecting the material mass into one layer at a time, starting with the lowermost layer.

4. A method according to claim 1, comprising isolating the layers from the casing by a suitable material.

* * * * *